US006056145A

United States Patent [19]

Rush et al.

[11] Patent Number: 6,056,145

[45] Date of Patent: May 2, 2000

[54] LID FOR CUPS WITH NON-HELICAL BRIM

[75] Inventors: Jonathan E. Rush, Easton, Pa.; Bruce R. Smith, Fairfield, Conn.; Thomas R. Toczek, Nazareth, Pa.; Daniel J. Geddes, Appleton, Wis.; Warren G. Wiedmeyer, Trevor, Wis.

[73] Assignee: Fort James Corporation, Deerfield, Ill.

[21] Appl. No.: 09/231,117

[22] Filed: Jan. 14, 1999

[51] Int. Cl.[7] ..... B65D 41/06

[52] U.S. Cl. ..... 220/297; 220/296; 220/784; 220/713; 215/318

[58] Field of Search ..... 220/297, 296, 220/293, 780, 784, 713; 215/318, 317, 329, 330

[56] References Cited

U.S. PATENT DOCUMENTS

| | | | |
|---|---|---|---|
| Re. 28,797 | 5/1976 | Brewer | 220/784 X |
| 1,440,985 | 1/1923 | Hammer . | |
| 1,495,323 | 5/1924 | Hammer . | |
| 1,496,310 | 6/1924 | Hammer . | |
| 2,128,959 | 9/1938 | Nicholls | 220/296 X |
| 2,947,463 | 8/1960 | Conklin . | |
| 2,977,019 | 3/1961 | Henchert | 220/784 |
| 3,065,875 | 11/1962 | Negoro | 220/784 |
| 4,702,389 | 10/1987 | Bozinovich et al. . | |

*Primary Examiner*—Allan N. Shoap
*Assistant Examiner*—Robin A Hylton
*Attorney, Agent, or Firm*—Burns, Doane, Swecker & Mathis, L.L.P.

[57] ABSTRACT

A lid for use on a cup having a radially outwardly projecting non-helical brim extending around a mouth thereof. The lid is formed of plastic and comprises a center portion, and a flexible skirt extending downwardly from an outer periphery of the center portion. The skirt includes a radially inwardly projecting annular restriction ring adapted to be positioned beneath the cup brim. The skirt includes a plurality of threads spaced apart circumferentially around the skirt. Each thread extends generally helically upwardly from a location disposed between the restriction ring and a bottom edge of the skirt. The threads intersect the restriction ring to form circumferentially spaced caesurae in the restriction ring.

16 Claims, 3 Drawing Sheets

FIG. 8
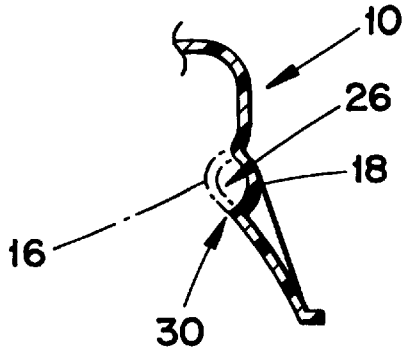
FIG. 9
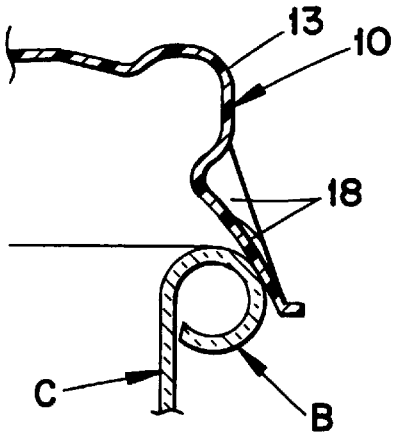
FIG. 10
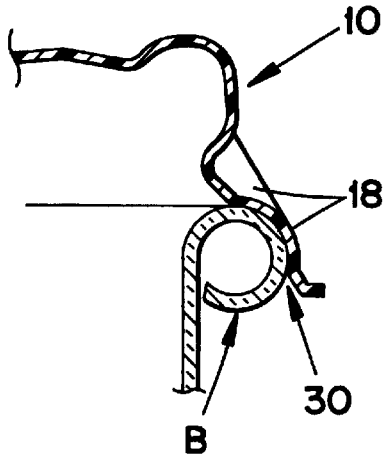
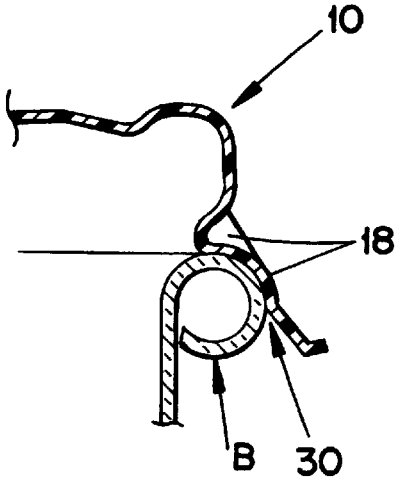
FIG. 11
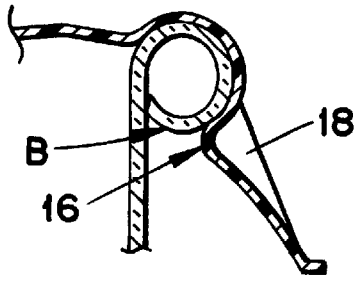
FIG. 12

LID FOR CUPS WITH NON-HELICAL BRIM

BACKGROUND OF THE INVENTION

The present invention relates to lids used for covering cups of the type having an annular brim extending around the mouth thereof, especially plastic lids attachable to disposable paper or plastic cups.

It is conventional to provide disposable cups with disposable plastic lids, especially cups employed in eating establishments where beverages are carried from the serving area by the customer for consumption within or outside of the establishment. The cup, which can be formed of paper, thermo formed plastic, injection molded plastic injection blow-molded plastic, or foamed plastic, for example, typically has a radially outwardly projecting annular (non-helical) bead extending around the cup mouth.

As depicted in FIGS. 1 and 2, one conventional type of lid 10A has a generally flat center portion 12A and a skirt 14A extending downwardly from an outer periphery of the center portion. The skirt includes a radially inwardly projecting annular restriction ring 16A which defines an opening of a diameter d smaller than the outside diameter of the lid brim and cup brim. Accordingly, when the lid is pressed onto the cup, the restriction ring is cammed outwardly by the cup brim and then snaps back to a position beneath the brim to secure the lid to the cup. Since the cup may be subjected to considerable handling by servers and customers after being filled and capped, it is necessary that the lid remain in place even when the cup is jarred or falls over.

It will thus be appreciated that it would be desirable to maximize the retention capabilities of the lids without making the lids more difficult to strip or remove from a molding apparatus.

SUMMARY OF THE INVENTION

The present invention relates to a lid adapted for use on a cup having a radially outwardly projecting non-helical brim extending around a mouth thereof. The lid is formed of plastic and comprises a center portion and a flexible skirt extending downwardly from an outer periphery of the center portion. The skirt includes a radially inwardly projecting annular restriction ring adapted to be located beneath a cup brim. The skirt further includes a plurality of threads spaced apart circumferentially around the skirt. Each thread extends generally helically upwardly from a location disposed between the restriction ring and a bottom edge of the skirt. The threads intersect the restriction ring to form circumferentially spaced caesurae in the restriction ring.

The invention also pertains to the combination of the lid with a cup having a radially outwardly projecting non-helical brim.

BRIEF DESCRIPTION OF THE DRAWING

The objects and advantages of the invention will become apparent from the following detailed description of a preferred embodiment thereof in connection with the accompanying drawing in which like numerals designate like elements and in which:

FIG. 8 is a sectional view taken along the line 8—8 in FIG. 4; and FIGS. 9–12 are fragmentary sectional views depicting, in stages, the insertion of the lid onto a cup according to the present invention.

DETAILED DESCRIPTION OF A PREFERRED EMBODIMENT OF THE INVENTION

A lid 10 according to the present invention is adapted to fit onto a cup C having a radially outwardly projecting annular (i.e., non-helical) brim B extending around a mouth of the cup.

Figure 1:
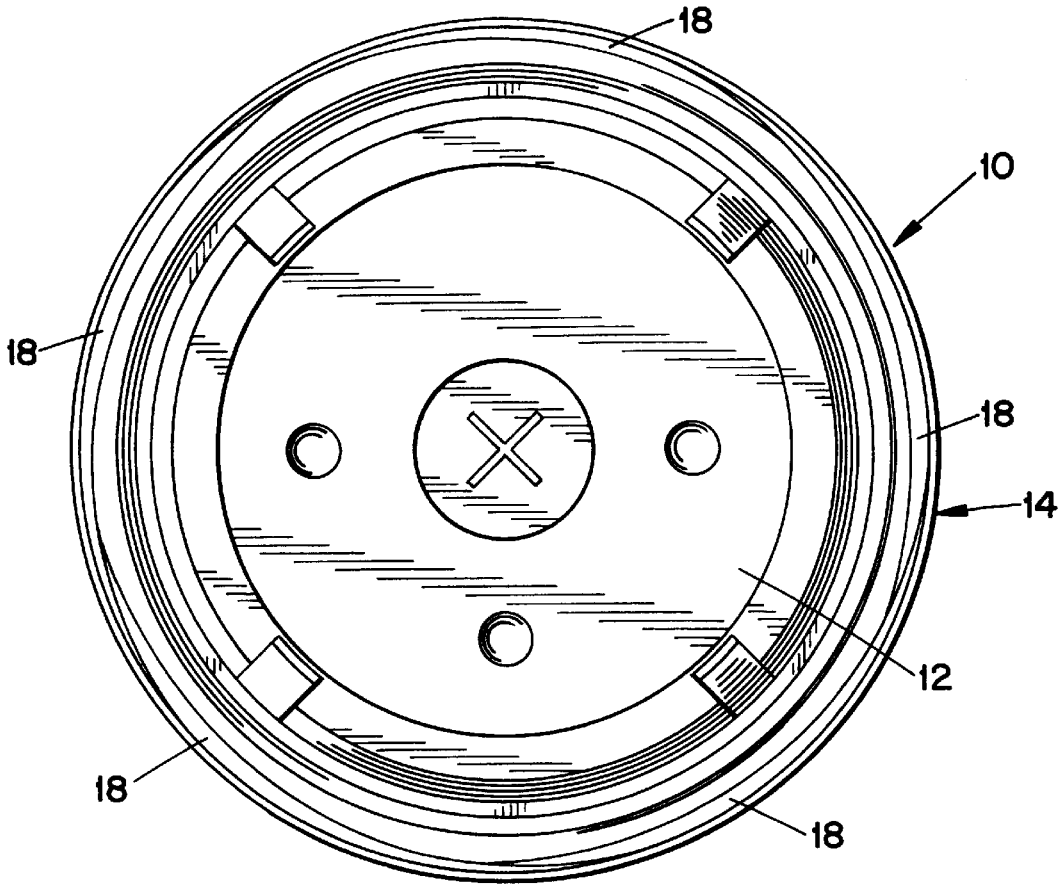
FIG. 1 is a bottom plan view of a plastic lid according to the present invention.
Figure 2:
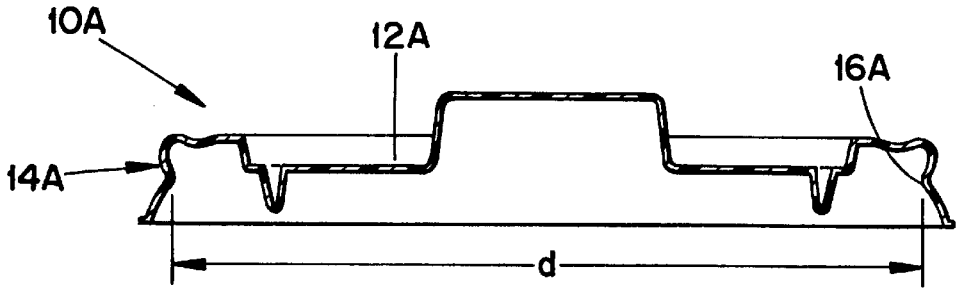
FIG. 2 (PRIOR ART)
FIG. 2 is a vertical sectional view taken through a conventional lid.
Figure 3:
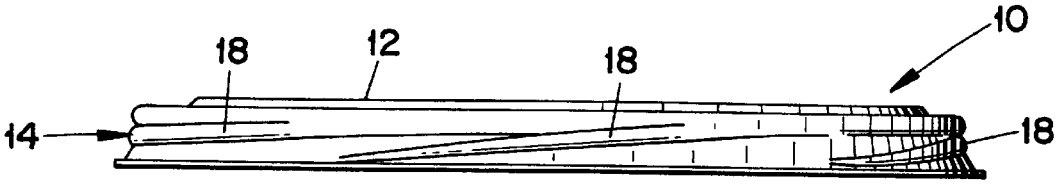
FIG. 3 is a side elevational view of the lid according to the present invention.
Figure 4:
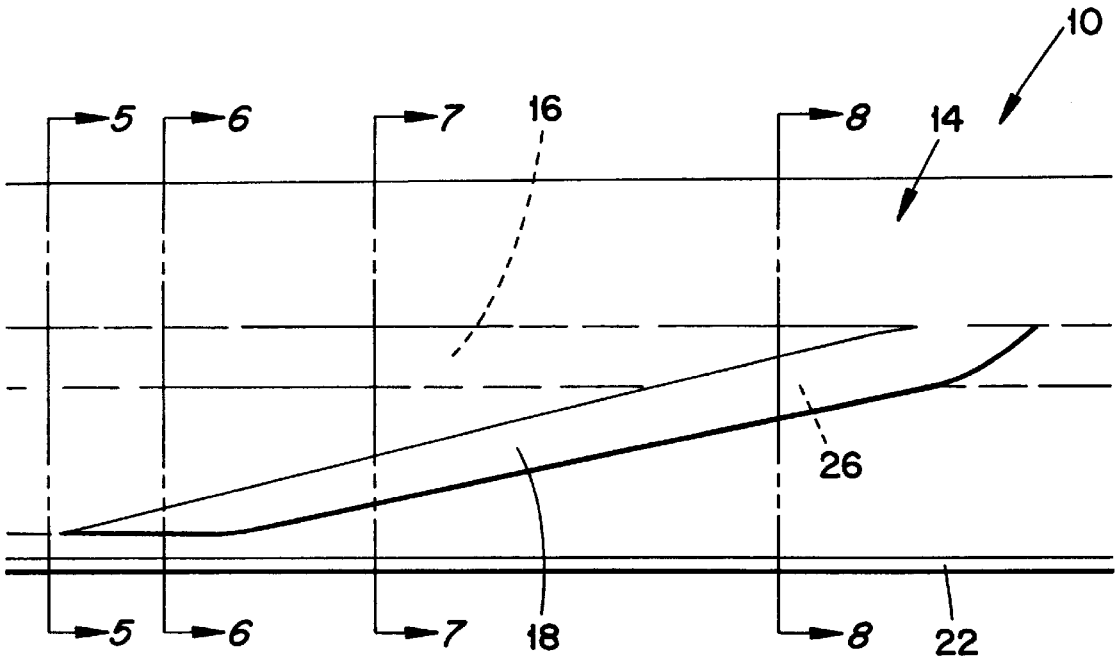
FIG. 4 is an enlarged fragmentary side elevational view of the lid shown in FIG. 3.

The lid 10 which is molded of plastic, such as high impact polystyrene (H.I.P.S.), includes a center portion 12, an annular bead 13, and a flexible skirt 14 extending downwardly from the bead 13. The skirt is flared downwardly and outwardly as can be seen in FIG. 3.

Figure 5:
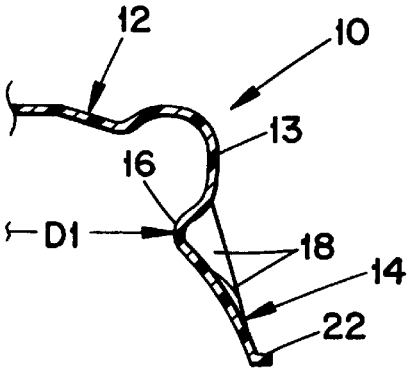
FIG. 5 is a sectional view taken along the line 5—5 in FIG. 4.
Figure 6:
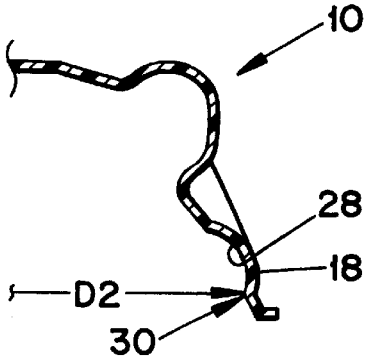
FIG. 6 is a sectional view taken along the line 6—6 in FIG. 4.
Figure 7:
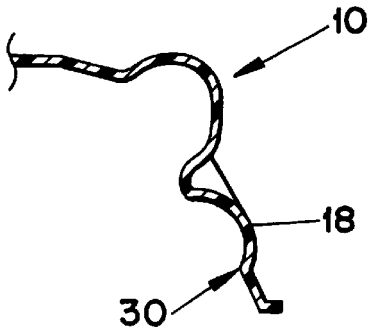
FIG. 7 is a sectional view taken along the line 7—7 in FIG. 4.

The skirt forms a radially inwardly projecting restriction ring 16 forming an inner diameter D1 (see FIG. 5) which is smaller than an outer diameter of the brim B, whereby the restriction ring assumes a position underlying the brim once the lid has been installed on the cup (see FIG. 12).

The skirt 14 further includes a plurality of threads 18 spaced apart circumferentially around the skirt. Each thread extends generally helically upwardly from a location disposed between the restriction ring 16 and a lower edge 22 of the skirt which is defined by a radially outwardly projecting flange.

The number of threads can be varied, but preferably there are at least three threads. Lids having any number of threads from three to nine have performed well.

Each thread traverses or intersects the restriction ring 16 to form a gap, caesura, or interruption 26 therein (see FIG. 8), the caesurae being spaced circumferentially apart.

Each thread forms an inwardly open groove 28, a lower portion of which forms an inwardly projecting ridge 30 extending generally helically and becoming of smaller inner diameter D2 as the thread advances toward the restriction ring, as is apparent from comparing FIGS. 5–8. It will also be appreciated from comparing FIGS. 6–8 that the depth of the groove 28 becomes progressively larger as the thread advances toward the restriction ring 16.

In practice, a lid can be installed on a cup either by being pressed-on, or by being rotated, i.e., twisted or screwed-on. When pressed on, the lid is usually initially loosely placed on the cup, whereby one side of the lid is lower than a diametrically opposite side. That is, the portion of the restriction ring 16 located on the lower side is disposed beneath the cup brim B, and the portion of the restriction ring located on the higher side is above the lid brim as shown in FIG. 9. As the higher side is pressed down, the brim B makes contact with the threads 18 (see FIG. 10) and thereby cams the flexible skirt 14 outwardly to enable the threads to pass thereover. This occurs gradually, since each thread extends helically. The skirt is gradually cammed farther outwardly since the inner diameter D2 of each thread becomes progressively smaller. Eventually, the restriction ring passes over the cup brim B, whereupon the skirt snaps back in to enable the restriction ring 16 to assume a position underlying the brim B.

As a result of the present invention, the inner diameter D1 of the restriction ring 16 can be made smaller than previously possible, enabling the lid to be more securely held on the cup. This can be done without excessively increasing the force necessary to install the lid onto a cup, because the caesurae 26 formed in the restriction ring 16 make it easier to flex the skirt and restriction ring 16 outwardly, thereby effectively offsetting any increase in such force caused by making the restriction diameter D1 smaller. Importantly, the presence of the caesurae 26 does not lead to increased leakage of liquid around the cup brim.

Furthermore, as regards the force necessary to remove the lid from the cup, any decrease in the circumferential restriction area resulting from the presence of the caesurae 26 is offset by making the internal restriction diameter D1 smaller. Thus, the force required to remove the lid from the cup does not change to an appreciable extent.

Moreover, the presence of caesurae 26 tends to facilitate stripping of the lid from a mold during manufacture, thereby offsetting any increase in the stripping force caused by decreasing the internal diameter D1. Various numbers of thread caesurae could be provided from three to nine, especially three, five, or nine threads.

In one type of lid, for example a lid for a 3.5 inch diameter cup brim, the present invention has enabled the diameter D1 to be reduced by 0.010 inches, thereby actually improving the retention properties of the lid on a cup.

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A lid adapted for use on a cup having a radially outwardly projecting non-helical brim extending around a mouth thereof, the lid formed of plastic and comprising a center portion, and a flexible skirt extending downwardly from an outer periphery of the center portion, the skirt including a radially inwardly projecting annular restriction ring adapted to be located beneath a cup brim, the skirt further including a plurality of threads spaced apart circumferentially around the skirt, each thread extending generally helically upwardly from a location disposed between the restriction ring and a bottom edge of the skirt, the threads intersecting the restriction ring to form circumferentially spaced caesurae in the restriction ring.

2. The lid according to claim 1 wherein each thread forms an inwardly open groove, a lower portion of the groove forming an inwardly projecting ridge extending generally helically and becoming of progressively smaller inner diameter as the thread advances toward the restriction ring.

3. The lid according to claim 1 wherein the skirt is flared downwardly and outwardly.

4. The lid according to claim 3 wherein a depth of each groove becomes progressively larger as the thread advances toward the restriction ring.

5. The lid according to claim 1 wherein a depth of each groove becomes progressively larger as the thread advances toward the restriction ring.

6. The lid according to claim 1 wherein there are at least three threads.

7. The lid according to claim 1 wherein there are five threads.

8. The lid according to claim 1 wherein there are 9 threads.

9. In combination, a cup having a radially outwardly projecting non-helical brim extending around a mouth thereof, and a lid mounted on the cup, the lid formed of plastic and comprising a center portion, and a flexible skirt extending downwardly from the center portion, the skirt including a radially inwardly projecting annular restriction ring located beneath the cup brim and underlying the brim, the restriction ring forming an internal diameter smaller than an outer diameter of the brim, the skirt further including a plurality of threads spaced apart circumferentially around the skirt, each thread extending generally helically upwardly from a location disposed between the restriction ring and a bottom edge of the skirt, the threads intersecting the restriction ring to form circumferentially spaced caesurae in the restriction ring.

10. The combination according to claim 9 wherein each thread forms an inwardly open groove, a lower portion of the groove forming an inwardly projecting ridge extending generally helically and becoming of progressively smaller inner diameter as the thread advances toward the restriction ring.

11. The combination according to claim 9 wherein the skirt is flared downwardly and outwardly.

12. The combination according to claim 11 wherein in a depth of each groove becomes progressively larger as the thread advances toward the restriction ring.

13. The combination according to claim 9 wherein a depth of each groove becomes progressively larger as the thread advances toward the restriction ring.

14. The combination according to claim 9 wherein there are at least three threads.

15. The combination according to claim 9 wherein there are five threads.

16. The combination according to claim 9 wherein there are nine threads.

* * * * *